US006702652B2

(12) United States Patent
Arai

(10) Patent No.: US 6,702,652 B2
(45) Date of Patent: Mar. 9, 2004

(54) METHOD OF GRINDING REAR SIDE OF SEMICONDUCTOR WAFER

(75) Inventor: Kazuhisa Arai, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 10/197,754

(22) Filed: Jul. 19, 2002

(65) Prior Publication Data

US 2003/0027501 A1 Feb. 6, 2003

(30) Foreign Application Priority Data

Aug. 3, 2001 (JP) ..... 2001-236763

(51) Int. Cl.[7] ..... B24B 7/00

(52) U.S. Cl. ..... 451/41; 451/63; 438/692; 156/345.12

(58) Field of Search ..... 451/41, 59, 63, 451/54; 438/692, 693; 156/345.11, 345.12

(56) References Cited

U.S. PATENT DOCUMENTS 5,260,169 A * 11/1993 Nakano ..... 430/314
5,434,094 A * 7/1995 Kobiki et al. ..... 437/40
6,245,676 B1 * 6/2001 Ueno ..... 438/687

* cited by examiner

*Primary Examiner*—Eileen P. Morgan
(74) *Attorney, Agent, or Firm*—Wenderoth, Lind & Ponack, L.L.P.

(57) ABSTRACT

A method of grinding the rear side of a semiconductor wafer, the front side of which has bumps formed thereon, includes the steps of: preparing semiconductor wafers whose front surfaces have a plurality of circuits formed in their lattice patterns; coating the front side of a selected semiconductor wafer with a resist material to form a resist layer thereon; forming a plurality of holes in each section of the resist layer at which are to be formed bumps corresponding to the circuits by removing the resist; plating at the holes with a metal to form bumps; putting the semiconductor wafer on a selected chuck table with resist layer, which is formed on its front side, laid on the chuck table in a grinding machine; and grinding the rear side of the semiconductor wafer. The bumps are lower than the thickness of the resist layer, and therefore, they are short of reaching the front surface of the semiconductor wafer, and therefore, the semiconductor wafer can be protected from cracking, which otherwise would be caused by concentration of the stress to the bumps on the front side of the semiconductor wafer while grinding the rear side thereof.

12 Claims, 5 Drawing Sheets

METHOD OF GRINDING REAR SIDE OF SEMICONDUCTOR WAFER

BACKGROUND OF THE INVENTION

1. Field of the Invention

The present invention relates to a method of grinding the rear side of a semiconductor wafer, on the front side of which bumps are formed.

2. Related Art

Referring to FIG. 11, a semiconductor wafer W1 has ICs, LSIs or other circuits formed on its front side, and a protection tape T1 is applied to the front side of the semiconductor wafer W1. The semiconductor wafer W1 is put on a chuck table 50 with its front side down, and the semiconductor wafer W1 is ground to a predetermined thickness by applying the grindstone 51 to its rear side and by rotating the grindstone 51.

Referring to FIG. 12, a semiconductor wafer W2 has terminals 52 (called "bumps") formed on its front side. A protection tape T2 whose adhesive layer is thick enough to bury the bumps 52, is applied to the front side. Alternatively a protection tape coated with ultraviolet-sensitive glue may be attached to the front side of the semiconductor wafer W2, and the tape is exposed to ultraviolet rays prior to the grinding so that the glue may be set. Thus, the stress applied to each bump is reduced in grinding so that the semiconductor wafer W2 may be prevented from cracking.

In either case the stress applied to the bumps 52 cannot be removed completely, and therefore, the cracking of semiconductor wafers cannot be prevented completely. Also, the necessity of using extra tapes as described above is economically disadvantageous.

It is, therefore, required that the cracking of semiconductor wafers having bumps formed on their front sides be completely prevented in grinding their rear sides without involving extra costs.

SUMMARY OF THE INVENTION

To meet such requirement a method of grinding the rear side of a semiconductor wafer according to the present invention comprises the steps of: preparing semiconductor wafers whose front surfaces have a plurality of circuits formed in lattice patterns; coating the front surface of a selected one of the semiconductor wafers with a resist material to form a resist layer thereon; forming a plurality of holes in the resist layer to extend through the resist layer to the front surface of the semiconductor wafer; forming a plurality of metal bumps to project as bumps from the front surface of the semiconductor wafer such that each of the metal bumps is disposed in one of the holes formed in the resist layer; positioning the semiconductor wafer, which has the metal bumps disposed in the holes of the resist layer, on a chuck table such that the resist layer is supported on the chuck table and the front surface of the semiconductor wafer faces the chuck table; and grinding a rear surface of the semiconductor wafer while the semiconductor wafer is positioned on the chuck table.

The method may further comprise the step of applying a protection tape to the resist layer at the front side of the semiconductor wafer such that, when the semiconductor wafer is positioned on the chuck table, the protection tape is in contact with the chuck table and supports the resist layer and the semiconductor wafer.

The bumps are lower than the thickness of the resist layer, and the bumps may be formed by plating at the holes with gold or a soldering metal, each bump being 50 to 200 $\mu$m in diameter, and 50 to 200 $\mu$m in height.

Other objects and advantages of the present invention will be understood from the following description of one preferred embodiment of the present invention, which is shown in the accompanying drawings.

DETAILED DESCRIPTION OF PREFERRED EMBODIMENT

Figure 1:
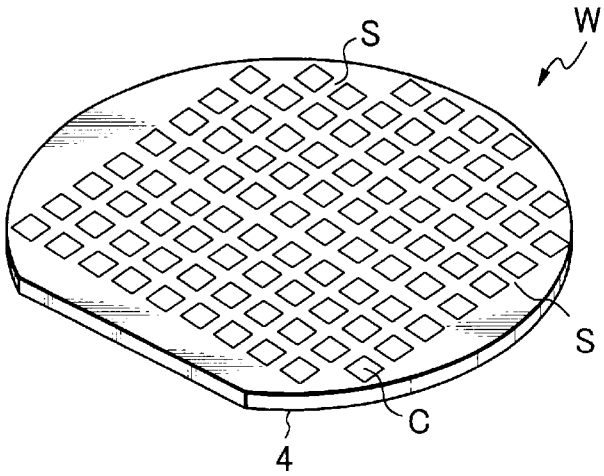
FIG. 1 is a perspective view of a semiconductor wafer, on which bumps are to be formed.

Referring to FIG. 1, a semiconductor wafer W has a plurality of crossing streets S formed on its front side, and each square section C has a circuit pattern formed therein.

Figure 2:
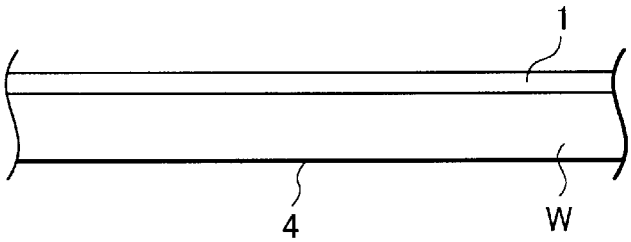
FIG. 2 is a front view of the semiconductor wafer, one surface of which a resist layer is formed.

As seen from FIG. 2, a resist material is coated over the whole surface of a semiconductor wafer W by a resist coater such as a spinning coater to form a resist layer 1 thereon. The resist thickness is formed larger than the height of bumps which are formed later.

Figure 3:
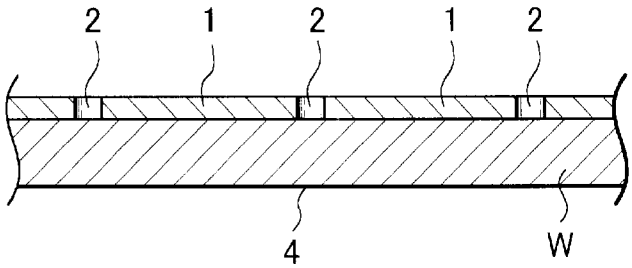
FIG. 3 illustrates, in section, how small holes are made in the resist layer of the semiconductor wafer.

With use of an aligner such as a stepping projection aligner, a number of minute holes 2 equal to the number of bumps to be formed later are made, as seen from FIG. 3, by removing the resist at the positions corresponding to the positions at which the bumps are to be formed, by exposure and developing. The diameter of the minute hole 2 is equal to that of the bump, which is to be made later.

Figure 4:
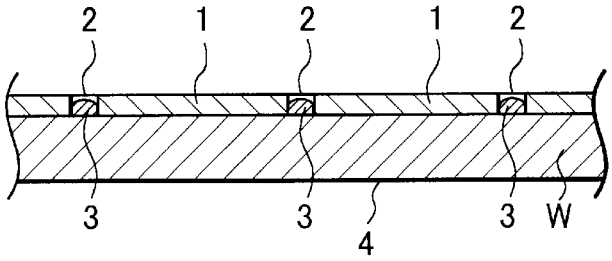
FIG. 4 illustrates, in section, how bumps are made in the small holes.
Figure 5:
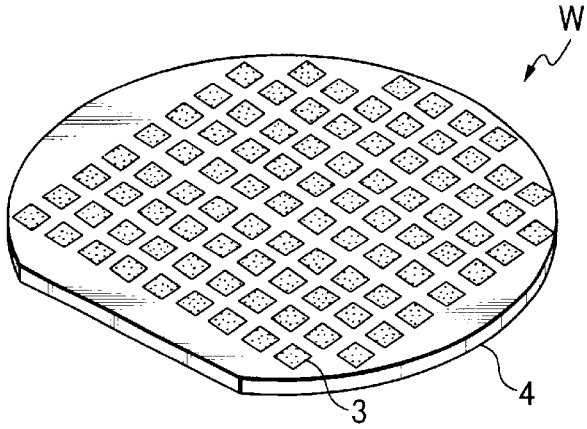
FIG. 5 is a perspective view of the semiconductor wafer having the bumps formed thereon.
Figure 6:
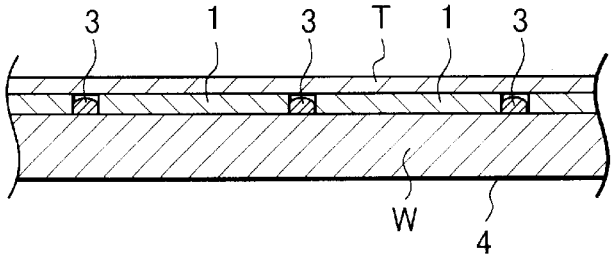
FIG. 6 shows the semiconductor wafer which has a protection tape applied to its resist layer to cover the bumps.

Bumps 3 are made by plating at the minute holes 2 with a metal as shown in FIG. 4. Specifically bumps 3 are made with gold or soldering metal, and each bump 3 is 50 to 200 $\mu$m in diameter, and 50 to 200 $\mu$m in height. In FIG. 5 all minute holes 2 are filled with bumps 3.

Then, the rear side 4 of the semiconductor wafer W is ground without removing the resist layer 1. The bumps 3 are short of reaching the upper surface of the resist layer 1, thus allowing the rear side 4 of the semiconductor wafer W to be ground without applying a protection tape T to the front side of the semiconductor wafer on which the bumps 3 are formed. Thus, the semiconductor wafer of FIGS. 4 and 5 can be ground as it is.

In a case that a protection tape T is applied to the front side of a semiconductor wafer W, the protection tape T used need not be a special type having a thick adhesive layer, and an ordinary protection tape can be used as is the case with the grinding of a bump-less semiconductor wafer. The manner in which a semiconductor wafer having no protection tape applied to its front side is ground is described below.

Figure 7:
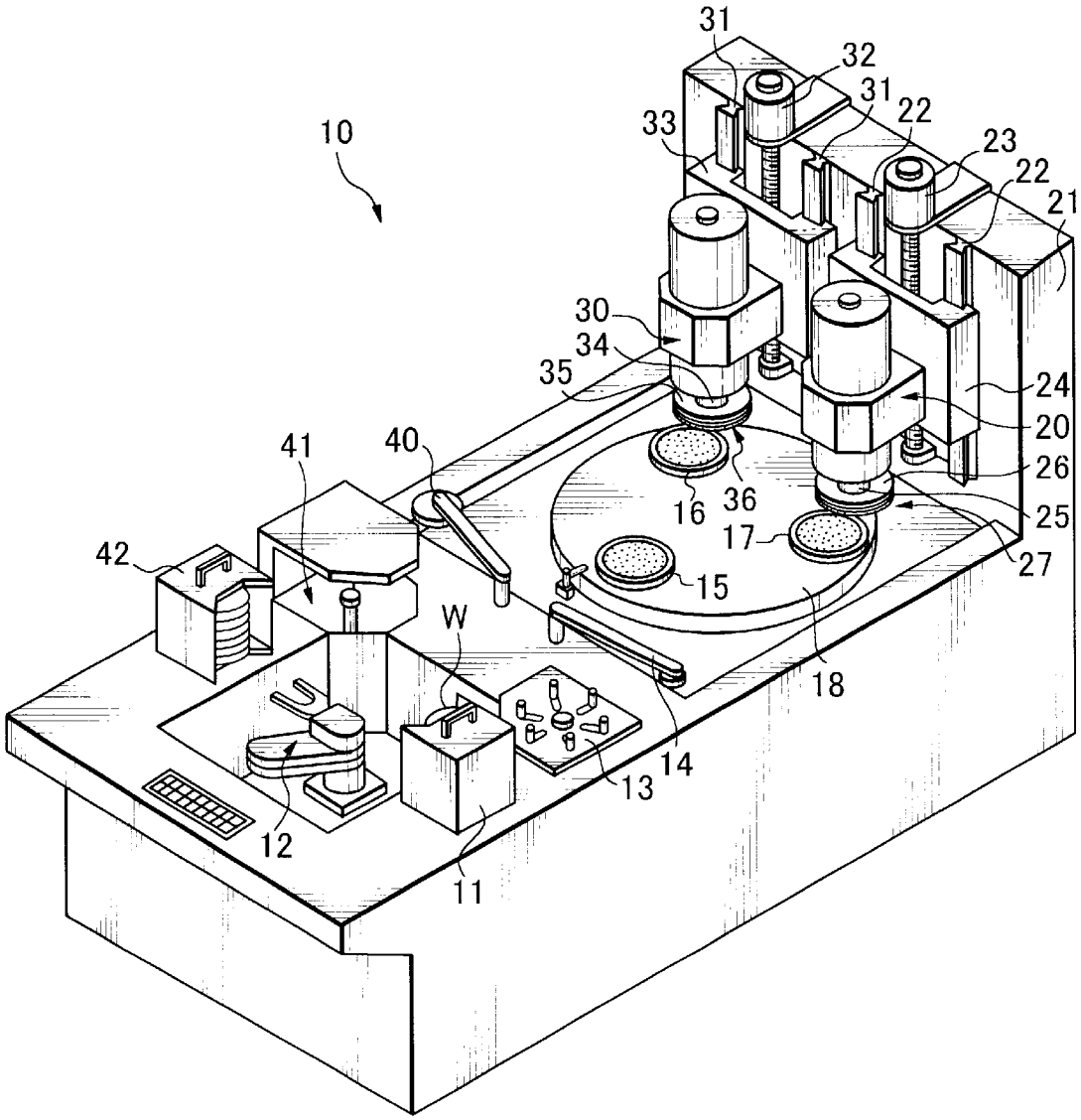
FIG. 7 is a perspective view of a grinding machine, which is used in grinding the rear sides of semiconductor wafers with bumps formed on their front sides.

In grinding the rear side of a semiconductor wafer W, a grinding machine 10 as shown in FIG. 7 can be used, and a plurality of semiconductor wafers W as shown in FIGS. 4 and 5 are put in a cassette 11.

Figure 8:
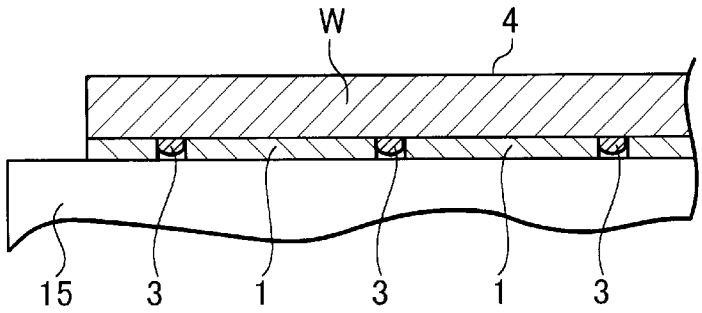
FIG. 8 illustrates, in section, a semiconductor wafer laid on a selected chuck table in the grinding machine.

A putting in-and-taking out means 12 takes semiconductor wafers one by one to turn each semiconductor wafer W upside down and put it on a positioning means 13. After the semiconductor wafer W is oriented there, a first transferring means 14 transfers the semiconductor wafer W to a selected chuck table 15 where the semiconductor wafer W is laid with its rear side 4 up, as seen from FIG. 8.

The chuck tables 15, 16 and 17 are rotatably supported by a turntable 18. The turntable 18 is rotated counterclockwise through predetermined angular intervals (120 degrees in the example of FIG. 7) to cause the semiconductor wafers W initially transferred onto a chuck table (e.g. 15) by the first transferring means 14 to move one after another to a position under a coarse grinding means 20.

Figure 9:
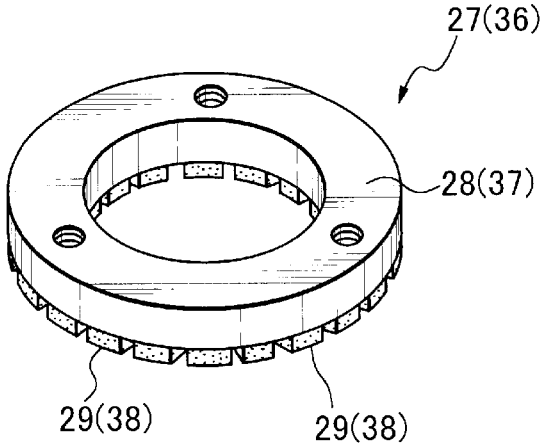
FIG. 9 is a perspective view of a grinding wheel having pieces of coarse or fine grindstone fixed to its lower side.
Figure 10:
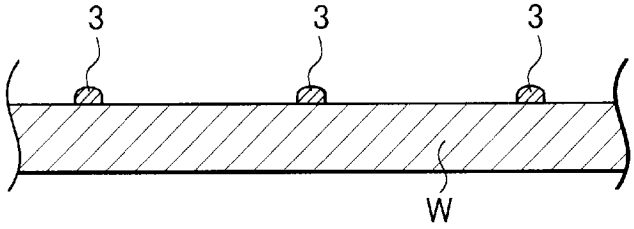
FIG. 10 illustrates, in section, a semiconductor wafer from which the resist layer is removed to expose the bumps.
Figure 11:
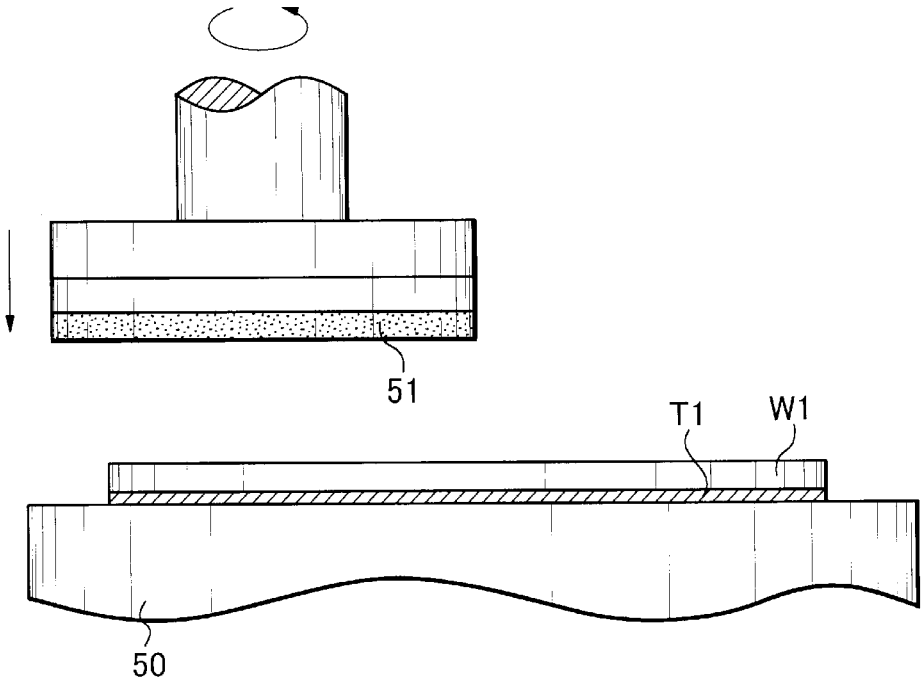
FIG. 11 illustrates how the rear side of a bump-less semiconductor wafer is ground.
Figure 12:
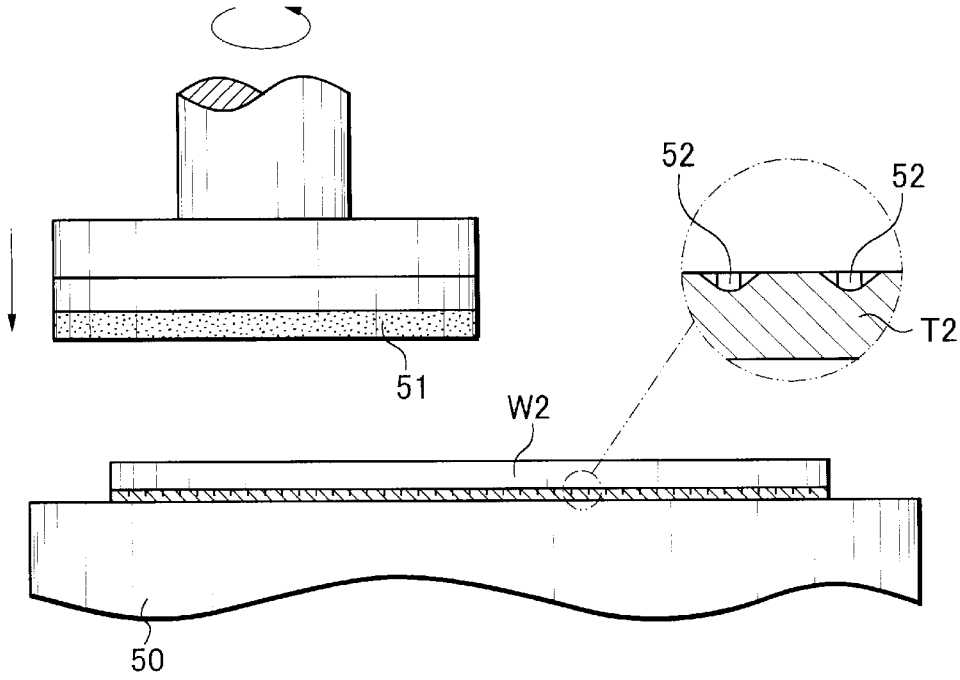
FIG. 12 illustrates how the rear side of a semiconductor wafer having bumps formed on its front side is ground.

The coarse grinding means 20 is carried by a carrier 24, which rides on a pair of vertical, parallel guide rails 22 laid on an upright wall 21. The carrier 24 can be raised or lowered by a drive motor 23, and accordingly the coarse grinding means 20 can be raised or lowered. The coarse grinding means 20 has a grinding wheel 27 attached to its spindle 25 via an associated mount 26. The grinding wheel 27 comprises an annular body 28 and pieces of grindstone 29 attached to the bottom of the annular body 28, as shown in FIG. 9.

While rotating the spindle 25, the grindstone 29 of the coarse grinding means 20 is lowered to be pushed against the rear side of the semiconductor wafer W, thereby effecting the coarse grinding on the semiconductor wafer W.

After finishing the coarse grinding, the turntable 18 is made to turn 120 degrees counterclockwise, and then, the coarse-ground wafer W is positioned under a fine grinding means 30.

The fine grinding means 30 is carried by a carrier 33, which rides on a pair of vertical, parallel guide rails 31 laid on the upright wall 21. The carrier 33 can be raised or lowered by a drive motor 32, and accordingly the fine grinding means 30 can be raised or lowered. The fine grinding means 30 has a grinding wheel 36 attached to its spindle 34 via an associated mount 35. The grinding wheel 36 comprises an annular body 37 and pieces of fine grindstone 38 attached to the bottom of the annular body 37, as shown in FIG. 9.

While rotating the spindle 34, the grindstone 38 of the fine grinding means 30 is lowered to be pushed against the rear side 4 of the semiconductor wafer W, thereby effecting the fine grinding on the semiconductor wafer W.

After finishing the fine grinding, the semiconductor wafer W is transferred to a washing means 41 by a second transporting means 40 to remove the debris from the semiconductor wafer W. The semiconductor wafer W thus cleaned is put in a cassette 42 by the putting in-and-taking out means 12.

As described above, all semiconductor wafers are taken out of the cassette 11 to be coarse- and fine-ground sequentially, and the finished semiconductor wafers are put in the cassette 42.

The rear side of each semiconductor wafer is ground while the bumps 3 are buried in the resist layer, thus preventing concentration of the stress to each bump, and permitting even distribution of the stress over the semiconductor wafer with the result that no cracking is caused in the semiconductor wafer.

Extra protection tapes having thick protection adhesive layers or ultraviolet-settable protection layers need not be used. This is advantageous to economy and productivity. The resist layer functions like a protection tape, and therefore the semiconductor wafer can be put on a chuck table with its resist layer facing the chuck table without the necessity of applying a protection tape to the semiconductor wafer. This will significantly improves the productivity.

All semiconductor wafers are taken out one by one from the cassette 42 to be transferred to a resist removing station where the resist layer 1 is removed from each semiconductor wafer, thus providing the semiconductor wafer W having its bumps 3 protruding from its front surface.

As may be understood from the above, the method of grinding the rear side of a semiconductor wafer according to the present invention provides the following advantages:

The grinding method permits the grinding of the rear side of the semiconductor wafer without removing the resist layer from its front surface, not allowing the stress to be concentrated to the bumps of the semiconductor wafer. Thus, the semiconductor wafer is guaranteed to be free of any cracking. Extra protection tapes need not be used, and accordingly the certainty, productivity and economy can be improved.

The resist layer functions like an extra type of protection tape, and therefore the semiconductor wafer can be put on a chuck table with its resist layer facing the chuck table without the necessity of applying an extra type of protection tape to the semiconductor wafer. This will significantly improve the economy and productivity.

In a case that a protection tape is applied to the resist layer, the resist layer can be removed along with the protection tape from the semiconductor wafer.

What is claimed is:

1. A method of processing a semiconductor wafer, comprising:

coating a front surface of a semiconductor wafer with a resist material to form a resist layer thereon;

forming a plurality of holes in said resist layer to extend through said resist layer to said front surface of said semiconductor wafer;

forming a plurality of metal bumps to project as bumps from said front surface of said semiconductor wafer, each of said metal bumps being disposed in one of said plurality of holes formed in said resist layer;

positioning said semiconductor wafer, which has said metal bumps disposed in said holes of said resist layer, on a chuck table such that said resist layer is supported on said chuck table and said front surface of said semiconductor wafer faces said chuck table; and grinding a rear surface of said semiconductor wafer while said semiconductor wafer is positioned on said chuck table.

2. A method according to claim 1, wherein in said forming of said plurality of metal bumps, said metal bumps are formed so as to project from said front surface of said semiconductor wafer an amount so that said metal bumps are short of reaching a front surface of said resist layer, such that, when said semiconductor wafer is positioned on said chuck table, said resist layer supports said semiconductor wafer.

3. A method according to claim 2, further comprising after said grinding of said rear surface of said semiconductor wafer, removing said resist layer from said front surface of said semiconductor wafer.

4. A method according to claim 1, further comprising after said forming of said metal bumps, applying a protection tape to said resist layer such that, when said semiconductor wafer is positioned on said chuck table, said protection tape is in contact with said chuck table and supports said resist layer and said semiconductor wafer.

5. A method according to claim 4, further comprising after said grinding of said rear surface of said semiconductor wafer, removing said resist layer from said front surface of said semiconductor wafer.

6. A method according to claim 4, wherein in said forming of said plurality of metal bumps, said metal bumps are formed so as to project from said front surface of said semiconductor wafer an amount so that said metal bumps are short of reaching a front surface of said resist layer.

7. A method according to claim 6, wherein said forming of said metal bumps comprises forming said metal bumps of gold or a soldering metal, such that each bump is 50 to 200 $\mu$m in diameter and 50 to 200 $\mu$m in height.

8. A method according to claim 4, wherein said forming of said metal bumps comprises forming said metal bumps of gold or a soldering metal, such that each bump is 50 to 200 $\mu$m in diameter and 50 to 200 $\mu$m in height.

9. A method according to claim 2, wherein said forming of said metal bumps comprises forming said metal bumps of gold or a soldering metal, such that each bump is 50 to 200 $\mu$m in diameter and 50 to 200 $\mu$m in height.

10. A method according to claim 1, wherein said forming of said metal bumps comprises forming said metal bumps of gold or a soldering metal, such that each bump is 50 to 200 $\mu$m in diameter and 50 to 200 $\mu$m in height.

11. A method according to claim 1, further comprising prior to coating the front surface of said semiconductor wafer with the resist material to form said resist layer, preparing a plurality of semiconductor wafers having front surfaces carrying a plurality of circuits formed in lattice patterns, and selecting said semiconductor wafer to be coated with said resist material from among said plurality of semiconductor wafers.

12. A method according to claim 1, further comprising after said grinding of said rear surface of said semiconductor wafer, removing said resist layer from said front surface of said semiconductor wafer.

* * * * *